US008699915B2

(12) United States Patent
Kim

(10) Patent No.: US 8,699,915 B2
(45) Date of Patent: Apr. 15, 2014

(54) PHOTOSENSITIVE BODY UNIT AND IMAGE FORMING APPARATUS INCLUDING THE SAME

(75) Inventor: Soo Yong Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 206 days.

(21) Appl. No.: 13/302,319

(22) Filed: Nov. 22, 2011

(65) Prior Publication Data

US 2012/0134712 A1 May 31, 2012

(30) Foreign Application Priority Data

Nov. 26, 2010 (KR) ..... 10-2010-0118780

(51) Int. Cl.
*G03G 21/18* (2006.01)

(52) U.S. Cl.
USPC ..... 399/112; 399/114; 399/119

(58) Field of Classification Search
USPC ..... 399/111, 112, 114, 119, 222
See application file for complete search history.

(56) References Cited

U.S. PATENT DOCUMENTS

| | | | |
|---|---|---|---|
| 2005/0002689 | A1 | 1/2005 | Jeong et al. |
| 2005/0002690 | A1 | 1/2005 | Park et al. |
| 2009/0067883 | A1* | 3/2009 | Jeon ..... 399/222 |

FOREIGN PATENT DOCUMENTS

| | | |
|---|---|---|
| JP | 5-46015 | 2/1993 |
| JP | 7-261543 | 10/1995 |
| JP | 2001-272838 | 10/2001 |

OTHER PUBLICATIONS

Machine translation of JP 5046015.*

European Search Report Issued on Apr. 17, 2012 in EP Patent Application No. 11190503.0.

* cited by examiner

*Primary Examiner* — Walter L Lindsay, Jr.

*Assistant Examiner* — Barnabas Fekete

(74) *Attorney, Agent, or Firm* — Stanzione & Kim, LLP

(57) ABSTRACT

Disclosed herein is a photosensitive body unit having an improved structure capable of disposing a developing unit at a correct position to supply developer to a photosensitive body, and an image forming apparatus including the photosensitive body unit. The image forming apparatus includes a main body, a photosensitive body housing mounted in the main body, a photosensitive body rotatably coupled to the photosensitive body housing, and a developing unit detachably mounted in the main body to supply developer to the photosensitive body. The photosensitive body housing includes a guide portion to determine a mounting position of the developing unit when the developing unit is mounted in the main body.

22 Claims, 7 Drawing Sheets

PHOTOSENSITIVE BODY UNIT AND IMAGE FORMING APPARATUS INCLUDING THE SAME

CROSS-REFERENCE TO RELATED APPLICATIONS

This application claims priority from and the benefit of Korean Patent Application No. 10-2010-0118780, filed on Nov. 26, 2010, in the Korean Intellectual Property Office, the disclosure of which is incorporated herein by reference in its entirety.

BACKGROUND

1. Field

Exemplary embodiments of the present general inventive concept relate to a photosensitive body unit having a structure that guides a developing unit to supply developer to the photosensitive body unit, and an image forming apparatus including the photosensitive body unit.

2. Description of the Related Art

Image forming apparatuses are used to form an image on a printing medium according to an input signal. Examples of such an image forming apparatus include a printer, a copier, a facsimile device, and a combination device integrating features thereof.

An electro-photographic image forming apparatus, which is one of a variety of image forming apparatuses, includes a photosensitive body, an optical scanning unit, and a developing unit. The optical scanning unit scans light to the photosensitive body charged with a predetermined electric potential to form an electrostatic latent image on the surface of the photosensitive body. The developing unit supplies developer to the photosensitive body, on which the electrostatic latent image is formed, in order to form a visible image.

In general, a developing roller provided in the developing unit comes into contact with the photosensitive body or is arranged to be evenly spaced apart from the photosensitive body so as to supply the developer to the photosensitive body. In this case, uniform supply of the developer, to prevent inferior printing quality, may be required. Thus, the developing roller must be regulated so that the developing roller is disposed at a correct position with respect to the photosensitive body, in order to uniformly supply the developer to the photosensitive body.

Further, since the photosensitive body unit and the developing unit occupy a large space in the image forming apparatus, it may be necessary to improve arrangement structures of and coupling structures between the photosensitive body unit and the developing unit, in order to decrease the size of the image forming apparatus.

SUMMARY

The present general inventive concept provides a photosensitive body unit having an improved structure in which a developing unit is disposed to supply developer to a photosensitive body at a correct position, and an image forming apparatus including the photosensitive body unit.

Additional features and utilities of the present general inventive concept will be set forth in part in the description which follows and, in part, will be obvious from the description, or may be learned by practice of the general inventive concept.

The present general inventive concept provides a photosensitive body unit and an image forming apparatus including the same, having an improved structure capable of decreasing the size of the image forming apparatus.

Exemplary embodiments of the present general inventive concept provide an image forming apparatus that includes a main body, a photosensitive body housing mounted in the main body, a photosensitive body rotatably coupled to the photosensitive body housing, and a developing unit detachably mounted in the main body to supply developer to the photosensitive body, wherein the photosensitive body housing includes a guide portion to determine a mounting position of the developing unit when the developing unit is mounted in the main body.

The photosensitive body housing may include a main frame and a first lateral frame and a second lateral frame disposed at opposite sides of the main frame, and the guide portion may be provided at the first lateral frame.

The image forming apparatus may further include a driving member to supply a driving force to the developing unit.

The developing unit may include a developing roller to apply the developer to a surface of the photosensitive body, a first driven roller to rotate the developing roller via the driving force transferred from the driving member, a connection shaft to connect the developing roller to the first driven roller, and a coupling frame to rotatably support the connection shaft.

The coupling frame may be seated in the guide portion.

The guide portion may include a receiving portion in which the coupling frame is seated, and a first recess portion formed to allow the first driven roller to rotate without interference from the first lateral frame.

The developing unit may further include a supply roller to supply the developer to the developing roller, and a second driven roller to rotate the supply roller. The guide portion may include a second recess portion formed to allow the second driven roller to rotate without interference from the first lateral frame.

The guide portion may include an opening into which the coupling frame is inserted.

The opening may be formed by opening one side of the receiving portion, and one end of the receiving portion, at which the opening is formed, may extend upward at an angle toward a direction from which the developing unit is received.

The first driven roller may include a plurality of protrusions that protrude from a side surface thereof so that the driving force is transferred from the driving member to the first driven roller.

Exemplary embodiments of the present general inventive concept may also provide an image forming apparatus that includes a main body, a photosensitive body housing mounted in the main body, a photosensitive body installed in the photosensitive body housing, and a developing sub-unit to supply developer to the photosensitive body, wherein the photosensitive body housing includes a main frame and a first lateral frame and a second lateral frame disposed at opposite sides of the main frame, the first lateral frame being provided with a guide portion to determine a mounting position of the developing sub-unit.

The guide portion may be provided at an outer peripheral surface of the first lateral frame.

The image forming apparatus may further include a driving member to supply a driving force to the developing sub-unit. The developing sub-unit may include a developing sub-unit frame defining an external appearance of the developing sub-unit, a developing roller to apply the developer to a surface of the photosensitive body, a first coupler to rotate the developing roller according to the driving force transferred from the driving member, a connection shaft to connect the developing roller to the first coupler, and a support portion provided at one side of the developing sub-unit to rotatably support the connection shaft.

The driving member may include a second coupler extending from one surface thereof to engage with the first coupler.

The developing sub-unit may be detachably mounted in the main body, and the support portion may be seated in the guide portion while the developing sub-unit is mounted in the main body.

The guide portion may include at least one first receiving portion to receive the support portion, and the first receiving portion may include an opening formed by opening one side thereof.

The at least one first receiving portion may include first receiving portions arranged at the outer peripheral surface of the first lateral frame, the first receiving portions being spaced apart from one another about a center of the photosensitive body.

The guide portion may further include a second receiving portion to receive the first coupler, the second receiving portion may be stepped from the first receiving portions.

Exemplary embodiments of the present general inventive concept may also provide an image carrier unit installed in an image forming apparatus including a main body, the image carrier unit provided in the main body, an image carrier mounted at the image carrier unit, and a developing unit to supply developer to the image carrier, the image carrier unit may include a main frame, a first lateral frame and a second lateral frame provided at opposite sides of the main frame, and a guide portion, in which the developing unit is mounted, provided at the first lateral frame.

The guide portion may include a seating portion to seat the developing unit and a guide protrusion to guide the developing unit to the seating portion.

Exemplary embodiments of the general inventive concept may also provide an image carrier unit disposed in an image forming apparatus, the image carrier unit may include a main frame; a first lateral frame and a second lateral frame disposed at opposite sides of the main frame; and a guide portion, in which a developing unit is mounted, provided at the first lateral frame.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EXEMPLARY EMBODIMENTS

Figure 1:
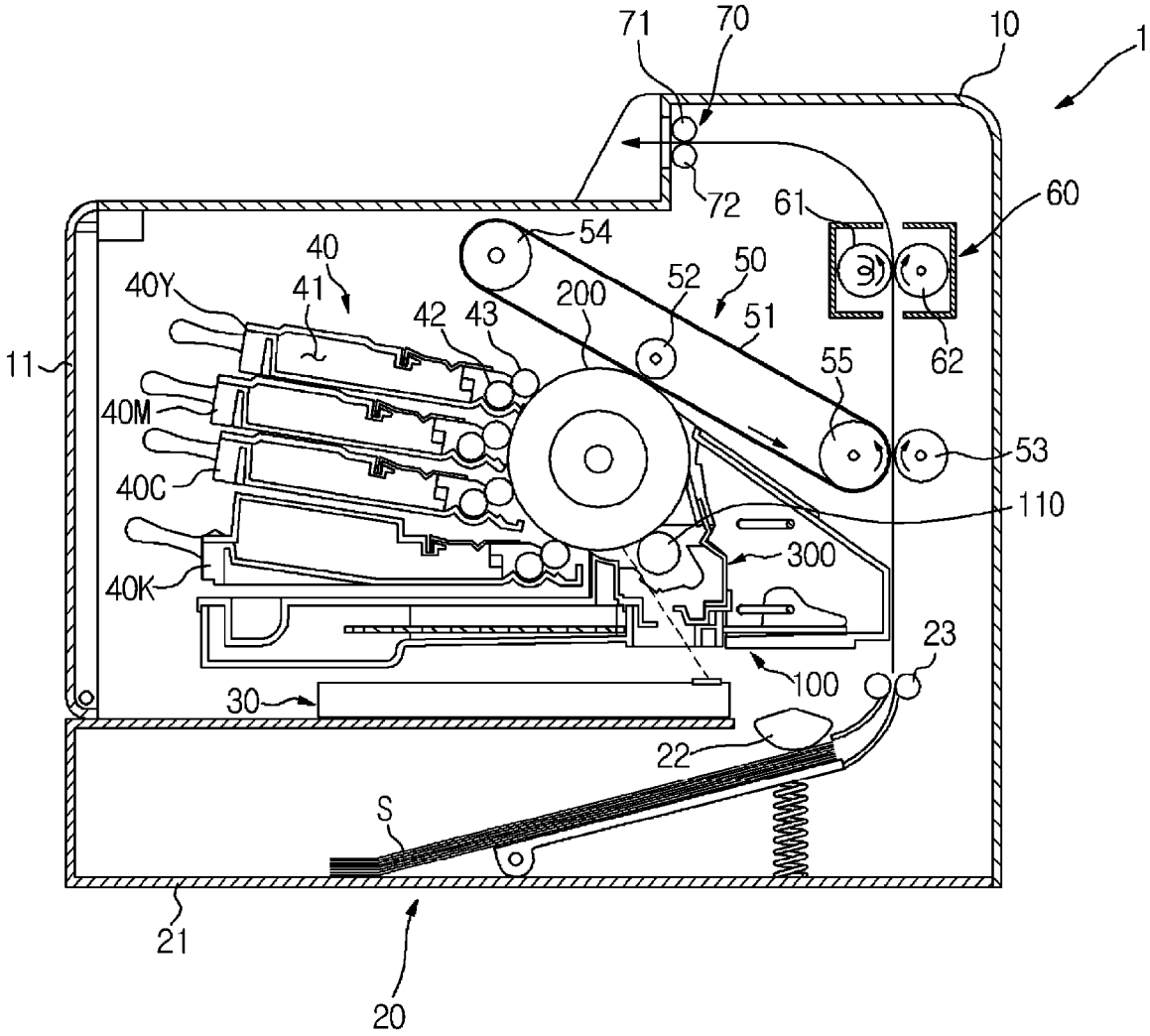
FIG. 1 is a view schematically illustrating a configuration of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to the like elements throughout. Exemplary embodiments are described below in order to explain the present general inventive concept while referring to the figures.

Figure 2:
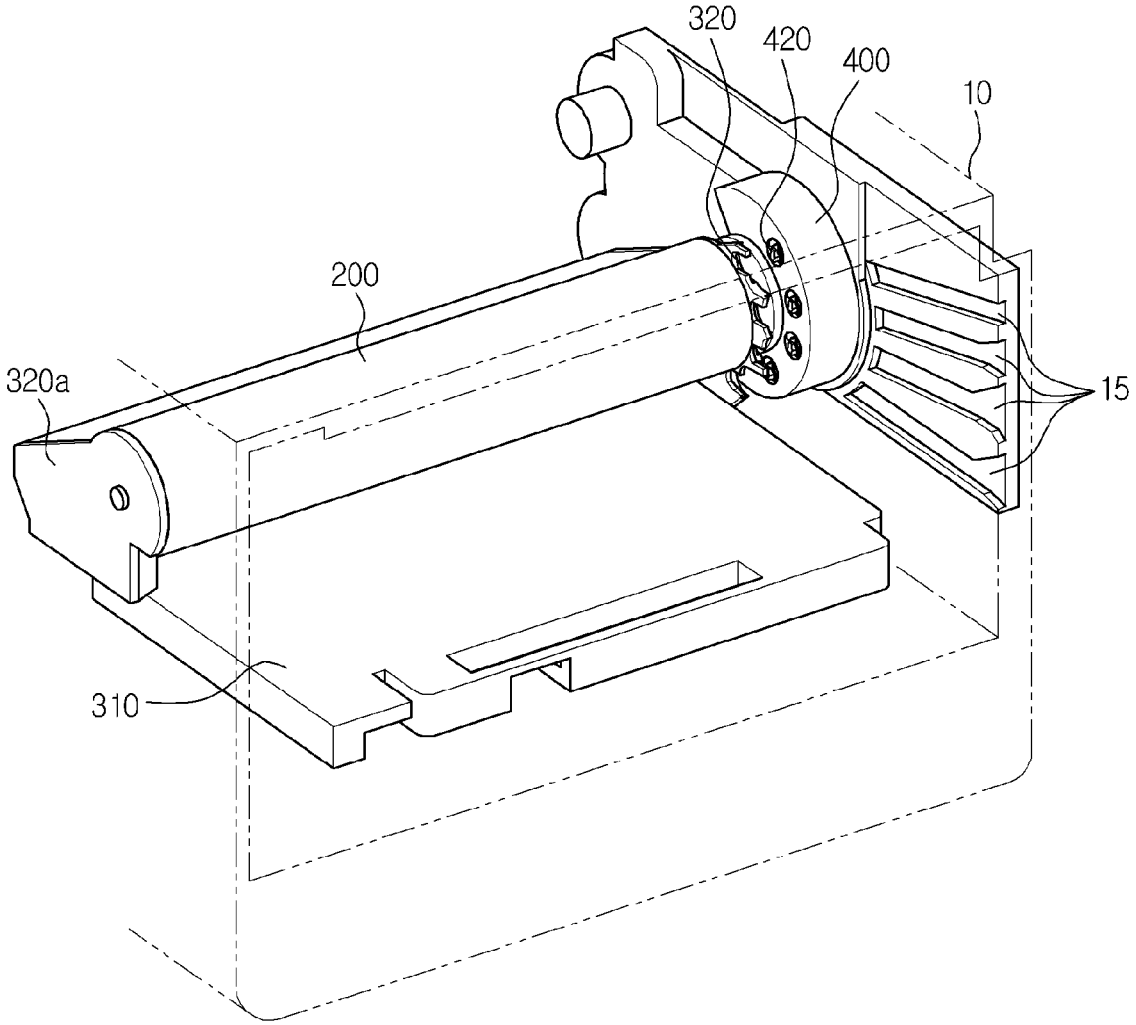
FIG. 2 is a perspective view illustrating of an image forming apparatus from which a developing unit is separated according to an exemplary embodiment of the present general inventive concept.
Figure 3:
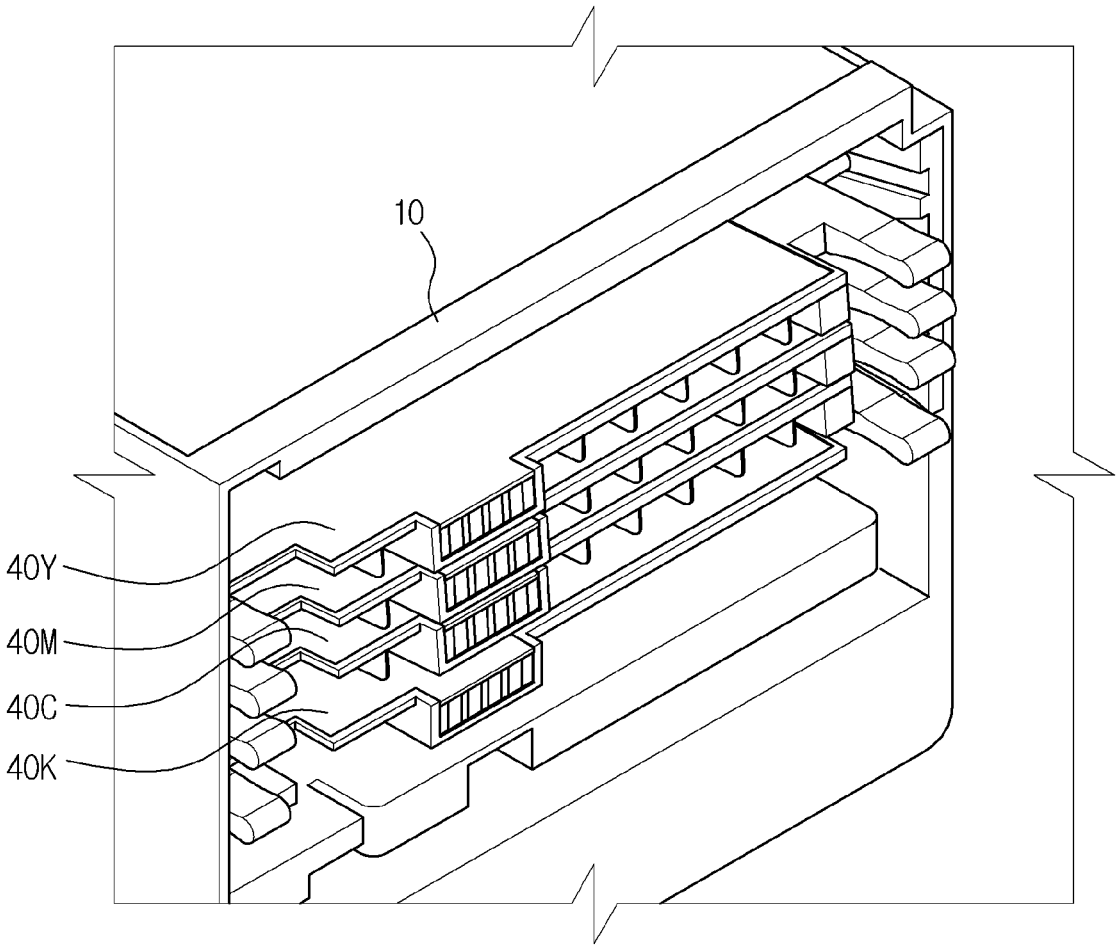
FIG. 3 is a perspective view illustrating the developing units mounted the main body of the image forming apparatus according to an exemplary embodiment of the present general inventive concept.

FIG. 1 is a view schematically illustrating a configuration of an image forming apparatus according to an exemplary embodiment of the present general inventive concept. FIG. 2 is a perspective view illustrating an image forming apparatus from which a developing unit is separated according to an exemplary embodiment of the present general inventive concept. FIG. 3 is a perspective view illustrating the developing units mounted in the main body of the image forming apparatus according to an exemplary embodiment of the present general inventive concept.

Referring to FIGS. 1 to 3, an image forming apparatus 1 includes a main body 10, a printing medium supply unit 20, an optical scanning unit 30, a photosensitive body unit 100, a developing unit 40, a transfer unit 50, a fixing unit 60, and a printing medium discharge unit 70.

The main body 10 defines an external appearance of the image forming apparatus 1, and also supports a variety of components installed therein. Also, a main body cover 11 is pivotally mounted at one side of the main body 10 to open and close a portion of the main body 10. A user may have access to the inside of the main body 10 through the main body cover 11 for attachment or detachment of components, such as the photosensitive body unit 100 and the developing unit 40.

The printing medium supply unit 20 includes a cassette 21 in which printing media S are stored, a pick-up roller 22 to pick up the printing media 5 stored in the cassette 21 sheet by sheet, and feeding rollers 23 to feed the picked-up printing medium S toward the transfer unit 50.

The optical scanning unit 30 is disposed to scan light corresponding to image information to the photosensitive body 200, thereby forming an electrostatic latent image on a surface of a photosensitive body 200. The optical scanning unit 30 may be disposed within the main body 10 and may be disposed beneath the photosensitive body unit 100; however, aspects need not be limited thereto.

The photosensitive body unit 100 includes a photosensitive body housing 300 and the photosensitive body 200, which is rotatably mounted in the photosensitive body housing 300. The photosensitive body 200 is an image carrier that carries the electrostatic latent image formed by the optical scanning unit 30 and a visible image formed by the developing unit 40. The photosensitive body unit 100 may be described as an image carrier unit.

The photosensitive body unit 100 may be detachably mounted or disposed in the main body 10. Accordingly, a user may repair or replace the photosensitive body unit 100 through the main body cover 11 if the photosensitive body unit 100 malfunctions.

A charging roller 110 is installed in the photosensitive body housing 300. The charging roller 110 charges the photosensitive body 200 to a reference electric potential prior to scanning of the light by the optical scanning unit 30.

The photosensitive body housing 300 may include a driving member 400, and the driving member 400 may be disposed on or at an outer side of the photosensitive body housing 300; however, aspects need not be limited thereto.

As shown in FIG. 2, the driving member 400 includes a driving coupler (not shown) and couplers 420. The driving coupler (not shown) serves to supply rotational driving force to the photosensitive body 200 rotatably mounted in the photosensitive body housing 300. The couplers 420 serve to supply rotational driving force to corresponding developing rollers 43 arranged at or disposed in the developing unit 40, respectively.

The driving coupler (not shown) is coupled to or in contact with one side surface of the driving member 400. The driving coupler (not shown) extends from a side surface of the driving member 400 to engage a photosensitive body coupler 220 (see FIG. 5) coupled to a central shaft 210 of the photosensitive body 200, thereby rotating the photosensitive body 200.

Each coupler 420 is coupled to or in contact with one side surface of the driving member 400. The coupler 420 extends from the side surface of the driving member 400 to engage a first driven roller 48 (see FIG. 6) connected to the corresponding developing roller 43, thereby rotating the developing roller 43.

The developing unit 40 supplies developer to the photosensitive body 200, on which an electrostatic latent image is formed, to form a visible image. The developing unit 40 may include four developing sub-units 40Y, 40M, 40C, and 40K, which receive different colors of developers, for example, yellow Y, magenta M, cyan C, and black B, respectively.

Each of the developing sub-units 40Y, 40M, 40C, and 40K includes a developer receptacle 41, a supply roller 42, and a developing roller 43. The developer receptacle 41 stores the developer to be supplied to the photosensitive body 200. The supply roller 42 supplies the developer stored in the developer receptacle 41 to the developing roller 43. The developing roller 43 applies the developer to the surface of the photosensitive body 200, on which an electrostatic latent image is formed, to form a visible image.

The transfer unit 50 includes an intermediate transfer belt 51, a first transfer roller 52, and a second transfer roller 53. The intermediate transfer belt 51 is supported by support rollers 54 and 55 and is operated to travel at the same speed as the linear velocity of the photosensitive body 200. The first transfer roller 52 is adjacent to and aligned with the photosensitive body 200, and the intermediate transfer belt 51 is disposed therebetween so as to transfer the visible image formed on the photosensitive body 200 to the intermediate transfer belt 51.

The second transfer roller 53 is adjacent to and aligned with the support roller 55, and the intermediate transfer belt 51 is disposed therebetween. The second transfer roller 53 may be spaced apart from the intermediate transfer belt 51 while transferring the image from the photosensitive body 200 to the intermediate transfer belt 51. After the image on the photosensitive body 200 is completely transferred to the intermediate transfer belt 51, the second transfer roller 53 comes into contact with the intermediate transfer belt 51 at a specific pressure. The second transfer roller 53 comes into contact with the intermediate transfer belt 51 to transfer the image from the intermediate transfer belt 51 to a printing medium S travelling between the intermediate transfer belt 51 and the second transfer roller 53.

The fixing unit 60 includes a heating roller 61 having a heat source and a pressure roller 62 disposed opposite the heating roller 61. As the printing medium S passes through a nip between the heating roller 61 and the pressure roller 62, the image is fixed to the printing medium S by heat transferred from the heating roller 61 and pressure between the heating roller 61 and the pressure roller 62.

Meanwhile, the printing medium discharge unit 70 includes a delivery roller 71 and a delivery backup roller 72 to discharge the printing medium S exiting the fixing unit 60 to the outside of the main body 10.

If a printing operation begins, the surface of the photosensitive body 200 is uniformly charged by the charging roller 110. Then, the optical scanning unit 30 scans light corresponding to the image information of one color, for example, yellow Y, to the uniformly charged surface of the photosensitive body 200. As a result, an electrostatic latent image corresponding to the image of yellow Y is formed on the photosensitive body 200.

Thereafter, a developing bias is applied to the developing roller 43 of the yellow developing sub-unit 40Y. Consequently, the yellow developer is attached to the electrostatic latent image so as to form a yellow visible image on the photosensitive body 200. The yellow visible image is transferred to the intermediate transfer belt 51 by the first transfer roller 52.

After transfer of the yellow visible image for one page is completed, the optical scanning unit 30 scans light corresponding to the image information of another color, for example, magenta M, to the photosensitive body 200, in order to form an electrostatic latent image corresponding to the image of magenta M. The magenta developing sub-unit 40M supplies the magenta developer to the electrostatic latent image so as to form a magenta visible image on the photosensitive body 200. The magenta visible image formed on the photosensitive body 200 is transferred to the intermediate transfer belt 51 by the first transfer roller 52. In this case, the magenta visible image overlaps with the previously transferred yellow visible image.

After the above-described process is performed using the cyan and black developers, a color image, which is an overlapped image of the yellow, magenta, cyan, and black colors, is completed on the intermediate transfer belt 51. Such a color image is transferred to the printing medium S, which passes through a nip between the intermediate transfer belt 51 and the second transfer roller 53. Subsequently, the printing medium is discharged to the outside of the main body 10 via the fixing unit 60 and the printing medium discharge unit 70.

During the printing process as described above, the mounting position of each developing sub-unit 40Y, 40M, 40C, or 40K in the developing unit 40 is regulated by the photosensitive body unit 100 so that each developing sub-unit 40Y, 40M, 40C, or 40K supplies a uniform amount of developer to the photosensitive body 200.

Figure 4:
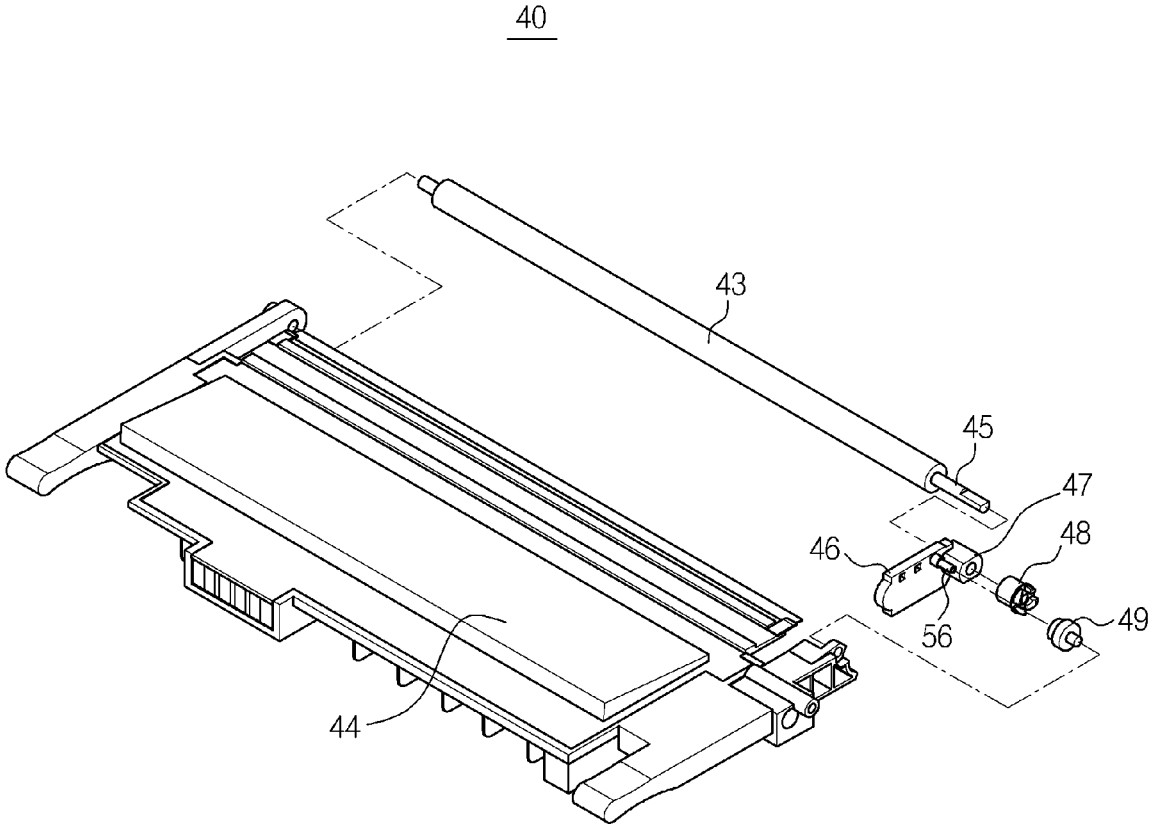
FIG. 4 is a perspective view illustrating one developing sub-unit according to an exemplary embodiment of the present general inventive concept.
Figure 5:
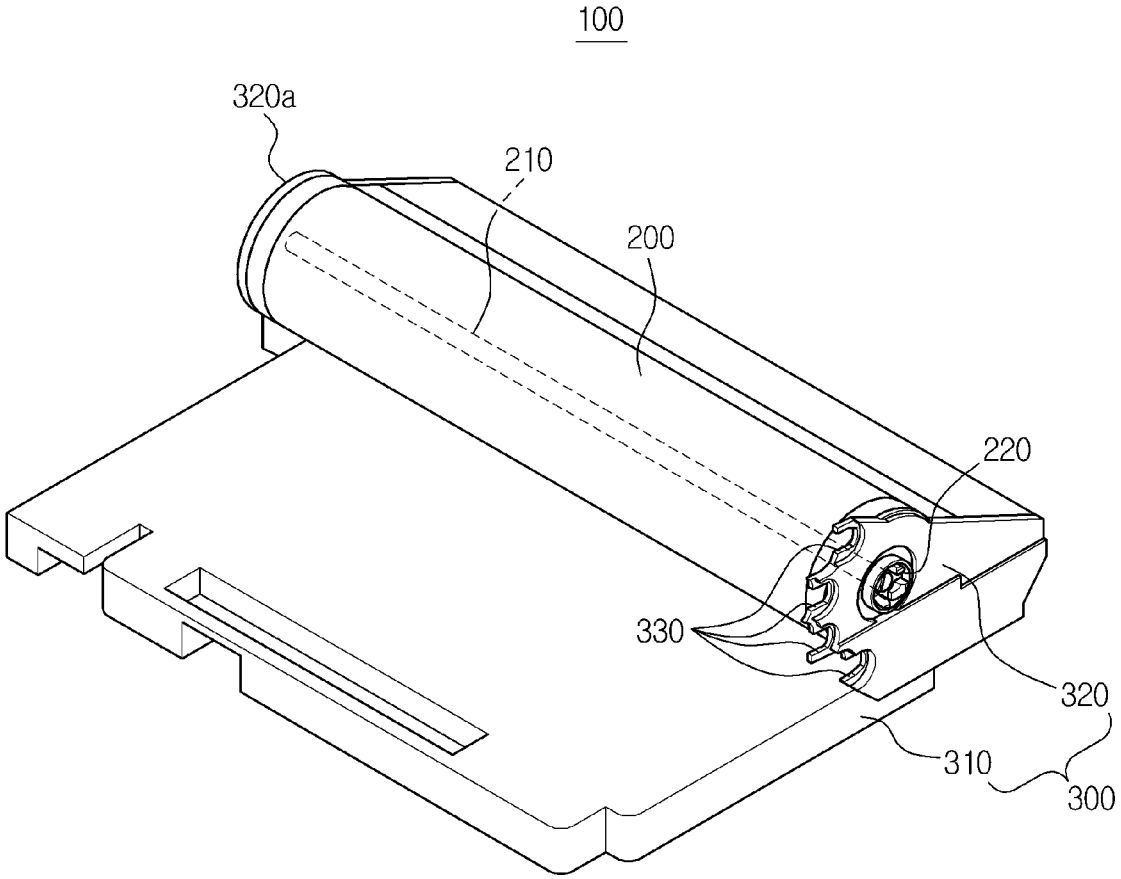
FIG. 5 is a perspective view illustrating a photosensitive body unit according to an exemplary embodiment of the present general inventive concept.
Figure 6:
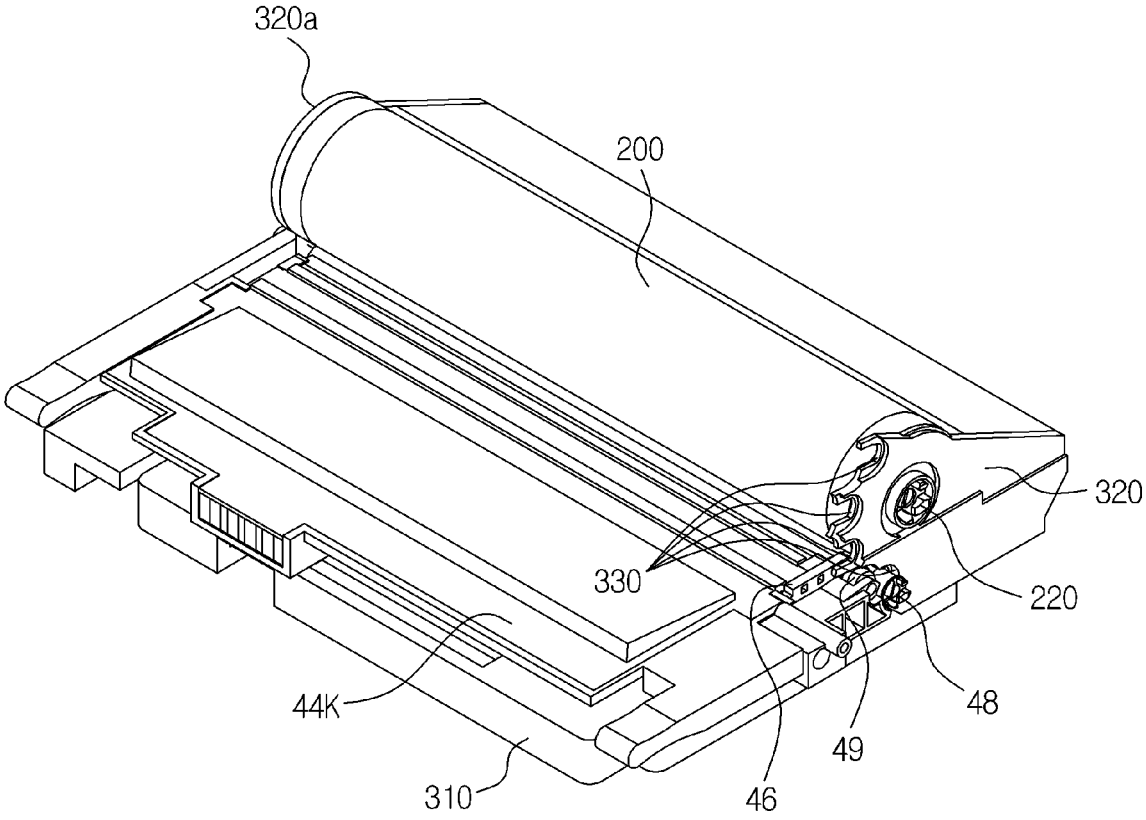
FIG. 6 is a perspective view illustrating a coupling relation between the photosensitive body unit and the developing unit according to an exemplary embodiment of the present general inventive concept.
Figure 7:
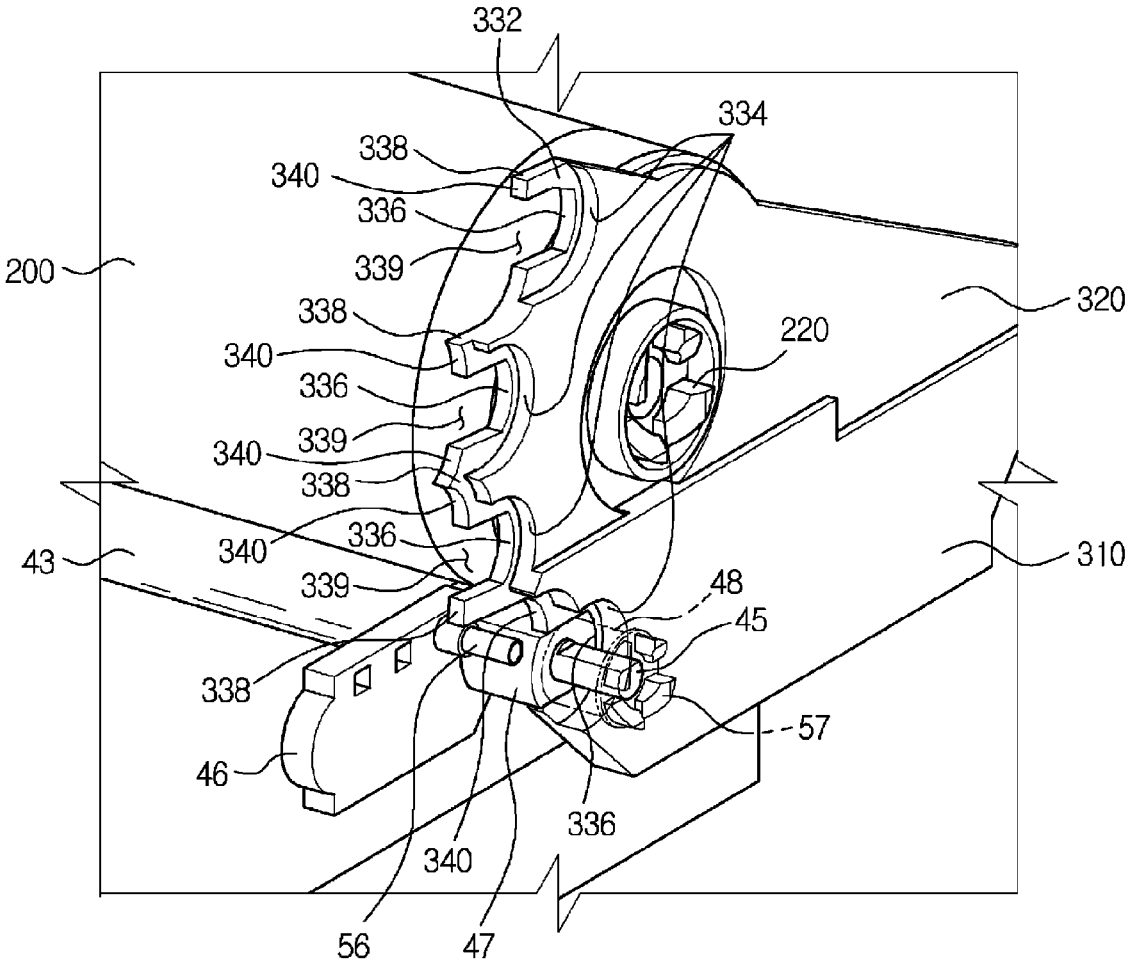
FIG. 7 is a perspective view illustrating a coupling relation between the photosensitive body unit and the developing unit according to an exemplary embodiment of the present general inventive concept.

FIG. 4 is a perspective view illustrating one developing sub-unit according to an exemplary embodiment of the present general inventive concept. FIG. 5 is a perspective view illustrating the photosensitive body unit according to an exemplary embodiment of the present general inventive concept. FIG. 6 is a perspective view illustrating a coupling relation between the photosensitive body unit and the developing unit according to an exemplary embodiment of the present general inventive concept. FIG. 7 is a perspective view illustrating a coupling relation between the photosensitive body unit and the developing unit according to an exemplary embodiment of the present general inventive concept.

As shown in FIGS. 1, 4, 6 and 7, each of the developing sub-units 40Y, 40M, 40C, and 40K includes a developing sub-unit frame 44, a coupling frame 46, a developing roller 43, and a supply roller 42. The coupling frame 46 is coupled to the developing sub-unit frame 44, and the developing roller 43 is rotatably coupled to the coupling frame 46. The supply roller 42 supplies the developer stored in the corresponding developer receptacle 41 to the developing roller 43.

The developing sub-unit frame 44 defines an external appearance of the corresponding developing sub-unit 40Y, 40M, 40C, or 40K. The respective developing sub-unit frames 44 house components of the developing sub-units 40Y, 40M, 40C, or 40K.

The coupling frame 46 is coupled to the developing sub-unit frame 44 to rotatably support the developing roller 43 and a second driven roller 49 of the corresponding developing sub-unit 40Y, 40M, 40C, or 40K. The coupling frame 46 includes a support portion 47 and a support shaft 56.

The support portion 47 rotatably supports a corresponding connection shaft 45 of the developing roller 43. That is, the support portion 47 protrudes from one side of the coupling frame 46, and the connection shaft 45 extends through the support portion 47 in order to connect the corresponding developing roller 43 and first driven roller 48. The connection shaft 45 may be coupled to or rotatably supported by the support portion 47 by extending therethrough to the first driven roller 48. The connection shaft 45 extends from one side surface of the developing roller 43 through the inside of the support portion 47 by a predetermined length to be connected to the first driven roller 48.

The first driven roller 48 engages with the corresponding coupler 420 (see FIG. 2) provided at the driving member 400 to rotate the corresponding developing roller 43. As shown in FIG. 7, the first driven roller 48 includes a plurality of protrusions 57 to which the rotational driving force is transferred from the coupler 420. The first driven roller 48 engages with the coupler 420 through the protrusions 57, and the first driven roller 48 may be referred to as a coupler corresponding to the coupler 420.

A bearing, or the like, (not shown) may be disposed between the support portion 47 and the connection shaft 45 so that the connection shaft 45 may be smoothly rotated.

While the developing sub-units 40Y, 40M, 40C, and 40K are mounted at the main body 10, the support portions 47 thereof are respectively disposed at corresponding first receiving portions 332 of a first lateral frame 320 of the photosensitive body housing 300. Such a structure and configuration will be described in detail below.

In each developing sub-unit 40Y, 40M, 40C, or 40K, the support shaft 56 is formed adjacent to the support portion 47 to rotatably support the second driven rollers 49. The second driven roller 49 engages with gears (not shown) provided in the main body 10, to transfer rotational driving force to the corresponding supply roller 42.

As described above, each coupling frame 46 may be provided independently of the corresponding developing sub-unit frame 44 and be coupled to the developing sub-unit frame 44. On the other hand, the coupling frame 46 and the developing sub-unit frame 44 may be integrally formed. In the case that the coupling frame 46 and the developing sub-unit frame 44 are integrated, the connection shaft 45 and the second driven roller 49 may be directly coupled to the support portion 47 and support shaft 56 formed at the corresponding developing sub-unit frame 44, respectively.

As shown in FIGS. 5 to 7, the photosensitive body unit 100 includes the photosensitive body housing 300 and the photosensitive body 200 rotatably mounted in the photosensitive body housing 300. The photosensitive body housing 300 includes a main frame 310, which defines an external appearance of the photosensitive body housing 300, and the first lateral frame 320 and a second lateral frame 320*a* disposed at or coupled to opposite sides of the main frame 310.

The central shaft 210 of the photosensitive body 200 is rotatably supported by the first lateral frame 320 and the second lateral frame 320*a*. The photosensitive body coupler 220 is coupled to the central shaft 210 to engage with the driving member 400 (see FIG. 2) installed at the main body 10 of the image forming apparatus.

As described above, the driving coupler (not shown) is coupled to or in contact with one side surface of the driving member 400. The photosensitive body coupler 220 engages with the driving coupler (not shown) extending from the side surface of the driving member 400 so that the photosensitive body coupler 220 is rotated by the driving coupler.

Also, the first lateral frame 320 includes, at an outer peripheral surface thereof, the guide portions 330 to regulate mounting positions of the developing sub-units 40Y, 40M, 40C, and 40K, respectively. The outer peripheral surface of the first lateral frame 320 may be a peripheral surface of the first lateral frame 320 opposite the photosensitive body 200. Although the drawings only show the guide portions 330 disposed or formed in the outer peripheral surface of the first lateral frame 320, aspects need not be limited thereto such that the guide portions may be disposed or formed only or additionally in the second lateral frame 320*a*.

Each of the guide portions 330 includes a first receiving portion 332 to receive the support portion 47 of the corresponding coupling frame 46, a second receiving portion 334 disposed to be stepped from the first receiving portion 332, and a recess portion 340 disposed between the first receiving portion 332 and the first receiving portion 332 of an adjacent guide portion 330.

The first receiving portion 332 may be formed by cutting the first lateral frame 320 from the outer peripheral surface thereof toward a center of the photosensitive body 200 to a predetermined length. The first receiving portion 332 includes a seating portion 336 to seat the corresponding support portion 47, a guide protrusion 338 to guide the support portion 47 to the seating portion 336, and an opening 339 disposed between adjacent guide protrusions 338.

The seating portion 336 has a substantially semicircular shape. As a result, the support portion 47 of each coupling frame 46 is seated in the corresponding seating portion 336 while the corresponding developing sub-unit 40Y, 40M, 40C, or 40K is mounted. The seating portion 336 may be disposed between two straight portions that extend away therefrom to at least partially form the guide protrusions 338 and the recess portions 340.

The seating portion 336 need not necessarily have the semicircular shape. The seating portion 336 may have a shape corresponding to a shape of the support portion 47 of the corresponding coupling frame 46 so as to allow the support portion 47 to be seated in the seating portion 336. Also, in the case that the support portion 47 has a shape different from a circular shape, the seating portion 336 may have a shape corresponding to the shape of the support portion 47.

Each guide protrusion 338 extends upward at an angle from the corresponding seating portion 336, i.e., the guide protrusion 338 extends upward at an angle toward a direction from which the corresponding developing sub-unit 40Y, 40M, 40C, or 40K is received. Consequently, the guide protrusion 338 guides the support portion 47 of the corresponding coupling frame 46 so as to seat the support portion 47 in the seating portion 336 when the corresponding developing sub-unit 40Y, 40M, 40C, or 40K is mounted.

Each opening 339 is provided between the corresponding guide protrusion 338 and the guide protrusion 338 of an adjacent first receiving portion 332 so that the corresponding support portion 47 is inserted into the seating portion 336 according to adjacent guide protrusions 338. The opening 339 may be formed by opening one side of the corresponding first receiving portion 332.

Each of the first receiving portions 332 receives a corresponding one of the developing sub-units 40Y, 40M, 40C, and 40K. Accordingly, when two or more developing sub-units are mounted in the main body 10 of the image forming apparatus 1, the number of the first receiving portions 332 provided in the image forming apparatus 1 may correspond to the number of the developing sub-units.

A plurality of first receiving portions 332 may be arranged at the outer peripheral surface of the first lateral frame 320 and may be spaced apart from one another about a rotational center of the photosensitive body 200 by a predetermined angle.

As described above, the developing sub-units 40Y, 40M, 40C, and 40K, which are detachably mounted at the main body 10, are respectively seated in the corresponding first receiving portions 332 provided in the first lateral frame 320 of the photosensitive body housing 300. As a result, the mounting position of each developing sub-unit 40Y, 40M, 40C, or 40K is regulated so that the developing roller 43 provided in each developing sub-unit 40Y, 40M, 40C, or 40K may supply a uniform amount of developer to the photosensitive body 200.

Also, the photosensitive body housing 300 directly supports the developing sub-units 40Y, 40M, 40C, and 40K. Therefore, a separate configuration to support each developing sub-unit 40Y, 40M, 40C, or 40K need not be provided in the main body 10, thereby reducing a required installation space.

Each second receiving portion 334 is formed to be stepped from the corresponding first receiving portion 332 in the longitudinal direction of the photosensitive body 200, i.e., a height of the step of the second receiving portion 334 extends from a surface of the first receiving portion 332 in the longitudinal direction of the photosensitive body 200 and in a direction away from the first lateral frame 320 opposite the photosensitive body 200. Accordingly, while the support portion 47 of each coupling frame 46 is located at the corresponding first receiving portion 332, the first driven roller 48 connected to each developing roller 43 may be rotated without interference with the first lateral frame 320 in the corresponding second receiving portion 334.

Each recess portion 340 is formed at the corresponding guide protrusion 338, i.e., the recess portions 340 may be formed at ends of the guide protrusions 338 disposed away from the first lateral frame 320.

The second driven rollers 49 respectively connected to the supply rollers 42 may rotate the corresponding supply rollers 42 without interference with the first lateral frame 320 in the respective recess portions 340.

Meanwhile, in terms of the configuration in which the second receiving portion 334 and recess portion 340 prevent the first and second driven rollers 48 and 49 from interfering with the first lateral frame 320, respectively, the second receiving portion 334 and recess portion 340 may be referred to as first and second recess portions, respectively.

The operation and process to mount the developing sub-units 40Y, 40M, 40C, and 40K in the main body 10 according to the above-described configuration will be described below with reference to FIGS. 1 to 7.

As shown in the drawings, the main body 10 is provided on opposite inner sides thereof with guide rails 15 so that the developing sub-units 40Y, 40M, 40C, and 40K may be detachably mounted in the main body 10. The guide rails 15 provided on the opposite inner sides of the main body 10 primarily guide the respective corresponding developing sub-units 40Y, 40M, 40C, and 40K so that the developing sub-units 40Y, 40M, 40C, and 40K may approach the photosensitive body housing 300.

If the respective developing sub-units 40Y, 40M, 40C, and 40K completely enter the inside of the main body 10 along the corresponding opposite guide rails 15, the support portion 47 of each developing sub-unit 40Y, 40M, 40C, or 40K is located at the corresponding first receiving portion 332 provided in the photosensitive body housing 300. During a process in which the support portion 47 is located at the first receiving portion 332, each guide protrusion 338 guides the corresponding support portion 47 so that the support portion 47 may be seated in the corresponding seating portion 336.

Since the support portion 47 fixed to each developing sub-unit 40Y, 40M, 40C, or 40K is located at the corresponding first receiving portion 332, as described above, the developing roller 43 rotatably fixed to each developing sub-unit 40Y, 40M, 40C, or 40K is disposed at a constant position. Consequently, a uniform amount of developer may be supplied to the photosensitive body 200.

After the developing sub-units 40Y, 40M, 40C, and 40K are completely mounted in the main body 10, the driving coupler (not shown) and each of the couplers 420, which are coupled to or in contact with one side surface of the driving member 400, extend from one side surface of the driving member 400. As a result, the driving coupler (not shown) and the coupler 420 respectively engage with the photosensitive body coupler 220 and the corresponding first driven roller 48, so as to be rotated together. The photosensitive body coupler 220 and each of the first driven rollers 48 transfer the rotational driving forces to the photosensitive body 200 and the corresponding developing roller 43, respectively, in order to rotate the photosensitive body 200 and the developing roller 43. Each of the developing rollers 43 supplies the developer to the photosensitive body 200 while coming into contact with the photosensitive body 200 or maintaining a uniform gap between the developing roller 43 and the photosensitive body 200.

Even if vibration is generated during an operation in which the developing rollers 43 supply developers to the photosensitive body 200, it may be possible to prevent printing quality from being degraded due to faulty supply of the developers since the position of each support portion 47 is regulated in the corresponding receiving portion 330.

As is apparent from the above description, in accordance with aspects of the present general inventive concept, the developing unit 40 may supply developer to the photosensitive body 200 while being regulated at a correct position, thereby preventing deterioration in printing quality.

Also, since the photosensitive body housing directly supports the developing unit 40, a space for a separate configuration to support the developing sub-unit 40Y, 40M, 40C, or 40K in the main body 10 need not be provided, thereby decreasing the size of the image forming apparatus 1.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body;

a developing unit detachably mounted in the main body to supply developer;

a photosensitive body to receive the developer; and a photosensitive body housing mounted in the main body, the photosensitive body housing comprising a guide portion to determine a mounting position of the developing unit when the developing unit is mounted in the main body, wherein the guide portion includes a receiving portion and a first recess portion disposed at an outer side of the receiving portion in an axial direction of the photosensitive body, and the photosensitive body is rotatably coupled to the photosensitive body housing.

2. The image forming apparatus according to claim 1, wherein:

the photosensitive body housing comprises a main frame and the first lateral frame and a second lateral frame disposed at opposite sides of the main frame; and the guide portion is provided at the first lateral frame.

3. The image forming apparatus according to claim 2, further comprising: a driving member to supply a driving force to the developing unit.

4. The image forming apparatus according to claim 3, wherein the developing unit further comprises:

a developing roller to apply the developer to a surface of the photosensitive body;

the first driven roller to rotate the developing roller via the driving force transferred from the driving member;

a connection shaft to connect the developing roller to the first driven roller; and the coupling frame to rotatably support the connection shaft.

5. The image forming apparatus according to claim 4, wherein the coupling frame is seated in the guide portion.

6. The image forming apparatus according to claim 4, wherein the receiving portion receives the coupling frame, and the first recess portion is formed to allow the first driven roller to rotate without interference from the first lateral frame.

7. The image forming apparatus according to claim 6, wherein:

the developing unit further comprises a supply roller to supply the developer to the developing roller, and a second driven roller to rotate the supply roller; and the guide portion comprises a second recess portion formed to allow the second driven roller to rotate without interference from the first lateral frame.

8. The image forming apparatus according to claim 7, wherein the guide portion comprises an opening into which the coupling frame is inserted.

9. The image forming apparatus according to claim 8, wherein one end of the receiving portion, at which the opening is formed, extends upward at an angle toward a direction from which the developing unit is received.

10. The image forming apparatus according to claim 4, wherein the first driven roller comprises a plurality of protrusions that protrude from a side surface thereof so that the driving force is transferred from the driving member to the first driven roller.

11. An image forming apparatus comprising:

a main body;

a developing sub-unit to supply developer;

a photosensitive body to receive the developer;

a photosensitive body housing mounted in the main body, the photosensitive body housing comprising a main frame and a first lateral frame and a second lateral frame disposed at opposite sides of the main frame, the first lateral frame being provided with a guide portion to determine a mounting position of the developing sub-unit, wherein the guide portion includes a first receiving portion and a second receiving portion disposed at an outer side of the first receiving portion in an axial direction of the photosensitive body, and the photosensitive body is installed in the photosensitive body housing.

12. The image forming apparatus according to claim 11, wherein the guide portion is provided at an outer peripheral surface of the first lateral frame.

13. The image forming apparatus according to claim 12, further comprising:

a driving member to supply a driving force to the developing sub-unit, wherein the developing sub-unit comprises:

a developing sub-unit frame defining an external appearance of the developing sub-unit;

a developing roller to apply the developer to a surface of the photosensitive body;

a first coupler to rotate the developing roller according to the driving force transferred from the driving member;

a connection shaft to connect the developing roller to the first coupler; and the support portion provided at one side of the developing sub-unit to rotatably support the connection shaft.

14. The image forming apparatus according to claim 13, wherein:

the driving member comprises a second coupler extending from one surface thereof to engage with the first coupler.

15. The image forming apparatus according to claim 13, wherein:

the developing sub-unit is detachably mounted in the main body; and the support portion is seated in the guide portion while the developing sub-unit is mounted in the main body.

16. The image forming apparatus according to claim 15, wherein:

the at least one first receiving portion to receives the support portion.

17. The image forming apparatus according to claim 16, wherein the at least one first receiving portion comprises first receiving portions arranged at the outer peripheral surface of the first lateral frame, the first receiving portions being spaced apart from one another about a center of the photosensitive body.

18. The image forming apparatus according to claim 17, wherein:

the second receiving portion receives the first coupler, the second receiving portion being stepped from the first receiving portion.

19. An image carrier unit disposed in an image forming apparatus including a main body, the image carrier unit provided in the main body, an image carrier mounted at the image carrier unit, and a developing unit to supply developer to the image carrier, the image carrier unit comprising:

a main frame;

a first lateral frame and a second lateral frame provided at opposite sides of the main frame; and a guide portion, in which the developing unit is mounted, provided at the first lateral frame, wherein the guide portion further comprises:

a first receiving portion disposed at a peripheral surface of the first lateral frame; and a second receiving portion disposed to extend from a surface of the first receiving portion in a direction away from the first lateral frame.

20. The image carrier unit according to claim 19, wherein the guide portion comprises a seating portion to seat the developing unit and a guide protrusion to guide the developing unit to the seating portion.

21. The image carrier unit of claim 19, wherein the direction away from the first lateral frame is opposite the image carrier.

22. The image carrier unit of claim 19, wherein the guide portion further comprises:

a guide protrusion to define at least a side of the first receiving portion; and a recess portion disposed at an end of the guide protrusion.

* * * * *